US005085391A

United States Patent [19]

Berger et al.

[11] Patent Number: 5,085,391

[45] Date of Patent: Feb. 4, 1992

[54] PLATE AND GLASS HOLDER

[76] Inventors: Irvin A. Berger; Barbara J. Berger, both of 24532 Eilat St., Woodland Hills, Calif. 91367; Neil C. Schneider; Karen J. Schneider, both of 23246 Covello St., West Hills, Calif. 91304

[21] Appl. No.: 538,991

[22] Filed: Jun. 15, 1990

[51] Int. Cl.[5] ..... B65D 21/02

[52] U.S. Cl. ..... 248/311.2; 220/23.83; 248/318

[58] Field of Search ..... 248/311.2, 312.1, 318, 248/682; 220/23.4, 23.83, 23.86; 211/41

[56] References Cited

U.S. PATENT DOCUMENTS

| | | | |
|---|---|---|---|
| D. 168,327 | 12/1952 | Alper | 220/23.83 X |
| 2,307,882 | 1/1943 | Freud | 248/311.2 X |
| 2,886,225 | 5/1959 | Clarke | 220/23.83 |
| 2,916,180 | 12/1959 | Alger . | |
| 3,955,672 | 5/1976 | Brundage | 206/72 |
| 4,461,396 | 7/1984 | Harper | 220/23.83 |
| 4,516,685 | 5/1985 | French | 220/23.83 |
| 4,607,758 | 8/1986 | Stevens | 220/23.83 |

FOREIGN PATENT DOCUMENTS

| | | | |
|---|---|---|---|
| 2297023 | 8/1976 | France | 220/23.83 |

*Primary Examiner*—Carl D. Friedman
*Assistant Examiner*—Derek J. Berger
*Attorney, Agent, or Firm*—Loyal M. Hanson

[57] ABSTRACT

A device for supporting a plate and a beverage container with one hand includes a body of material having a surface with which to support a plate, the body of material being dimensioned and arranged to enable a user to hold the body of material in one hand with the surface in an upwardly facing position. The body of material includes structure for inhibiting lateral movement of the plate while the body of material is so held with the plate on the surface, together with structure for supporting a beverage container next to the plate. The device inhibits lateral movement of the plate by being dimensioned and arranged to cradle the plate, one embodiment taking the form of a shallow, bottomless dish having a peripheral receptacle for the beverage container.

10 Claims, 1 Drawing Sheet

5085391

PLATE AND GLASS HOLDER

BACKGROUND OF THE INVENTION

1. Technical Field

This invention relates generally to food and beverage service, and more particularly to a device that facilitates such service away from a conventional table setting.

2. Background Information

People often partake of food and beverage under circumstances such that they must hold both the food and the beverage in their hands as they attempt to consume it. They may do so while standing at a business or social gathering, for example, or while lounging aboard a cruise ship or picnicking. Whatever the situation, eating that way can be somewhat difficult and so we need some way to make the experience more enjoyable.

Consider a typical cocktail party guest. Conversing with others in a crowded room, the guest holds a plate of hors d'oeuvres in the left hand and a glass of some beverage in the right. In order to sip the beverage, they simply raise the glass to their lips. But in order to taste one of the hors d'oeuvres, they must first find a place to set the glass, or transfer it to their left hand and attempt to hold both the plate and glass with one hand. Then, they pick up one of the hors d'oeuvres with the fingers of their right hand. Once finished with the hors d'oeuvres, they again grip the glass with their right hand for the next sip. So, the process is cumbersome and prone to cause embarrassing spillage that can result in property damage and even personal injury.

Various existing devices attempt to solve the problem. For example, the plate described in U.S. Pat. No. 4,516,685 issued to French (the French plate) includes a recess in which a glass can be placed. Although that facilitates one-handed holding of a plate and glass, it requires use of the French plate. That may be undesirable because the French plate may be less readily available and more expensive than other types of plates commonly used for such purposes, such as five to eight inch glass or china plates or the commercially available, plain, disc-shaped paper or plastic plates currently in such wide-spread usage (i.e., those commonly referred to as discardable party plates).

One could conceivably use the French plate to hold a discardable party plate or one of the other plates mentioned above. But that arrangement may not work too well because the other plate would rest on the upper surface of the bottom of the French plate where it might tend to slide off. Besides, using the French plate with another plate means the added cost and inconvenience of using two plates. Thus, the French plate is somewhat incompatible with existing plates and so users need some other solution.

U.S. Pat. No. 2,916,180 issued to Alger describes a plate holder designed to hold a paper plate and a drinking glass. It is compatible with discardable party plates in a way the French plate is not, but it involves somewhat complicated and expensive structure. In addition, it is bulky and uses a closed-bottom glass holder that may tend to accumulate food residue. Moreover, a long stem wine glass may not be very stable in the glass holder. So a better way is needed.

SUMMARY OF THE INVENTION

This invention solves the problems outlined above by providing a device for supporting a plate and beverage container with one hand that takes the form of a bottomless dish. The bottomless dish has a first portion that is dimensioned and arranged to receive and support the plate (such as a five to eight inch glass or china plate or conventional, discardable, party plate) and a second portion that is dimensioned and arranged to support the beverage container. The bottomless dish cradles the plate to inhibit lateral movement while a user supports both the plate and the beverage container by holding the bottomless dish in one hand.

Thus, the device is compatible with existing plates. It is relatively uncomplicated and inexpensive. It is less bulky. It can be configured to make it stackable. It avoids compartments prone to collect food residue, and it can be reused without cleaning after each use.

Generally, a device constructed according to the invention includes a body of material having a surface on which a user can place a plate in order to support the plate. The body of material is dimensioned and arranged to enable a user to hold the body of material in one hand with the surface in an upwardly facing position. According to one aspect of the invention, the body of material includes means for inhibiting lateral movement of the plate while the body of material is held with the plate on the surface. In addition, it includes means for supporting a beverage container next to the plate.

Those things are accomplished without complicated structure or food-collecting compartments. The means for inhibiting lateral movement of the plate includes a first portion of the body of material that is dimensioned and arranged to cradle the plate. For that purpose, the first portion may include a circularly shaped, bottomless depression in which to place the plate, the bottomless feature avoiding the accumulation of food residue and associated need for continual cleaning. The means for supporting the beverage container includes a second portion of the body of material that defines an opening dimensioned and arranged as a receptacle for the beverage container. It is also bottomless. In addition, the second portion includes a channel or accessway that enables passage of the stem of a conventional wine glass to a position extending through the opening.

For purposes of keeping the device light and less bulky and yet somewhat rigid, the body of material may include one or more beads disposed along a peripheral edge of the body of material, the periphery of the central opening in the first portion, and/or the periphery of the bottomless opening in the second portion. The device may be composed of a suitably rigid material, such as plastic. It may employ unitary one-piece construction, it may be configured to make it stackable, and, preferably, it has a diameter somewhat larger than the diameter of a conventional plate of predetermined size, such as the commercially available seven and nine inch diameter party plates.

DESCRIPTION OF THE PREFERRED EMBODIMENT

Figure 1:
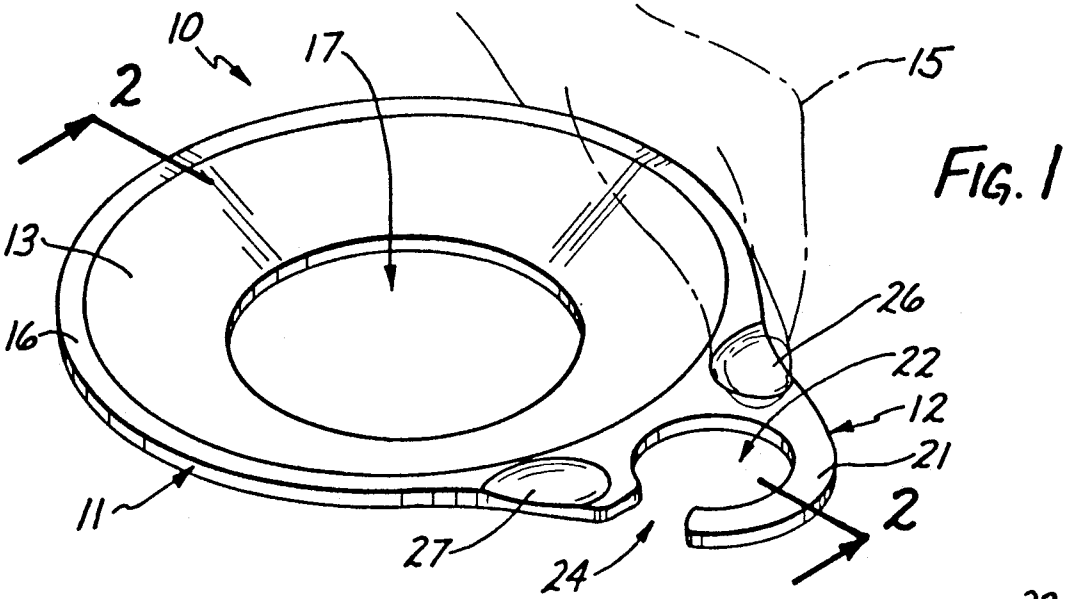
FIG. 1 of the drawings is a perspective view of a device constructed according to the invention.
Figure 2:
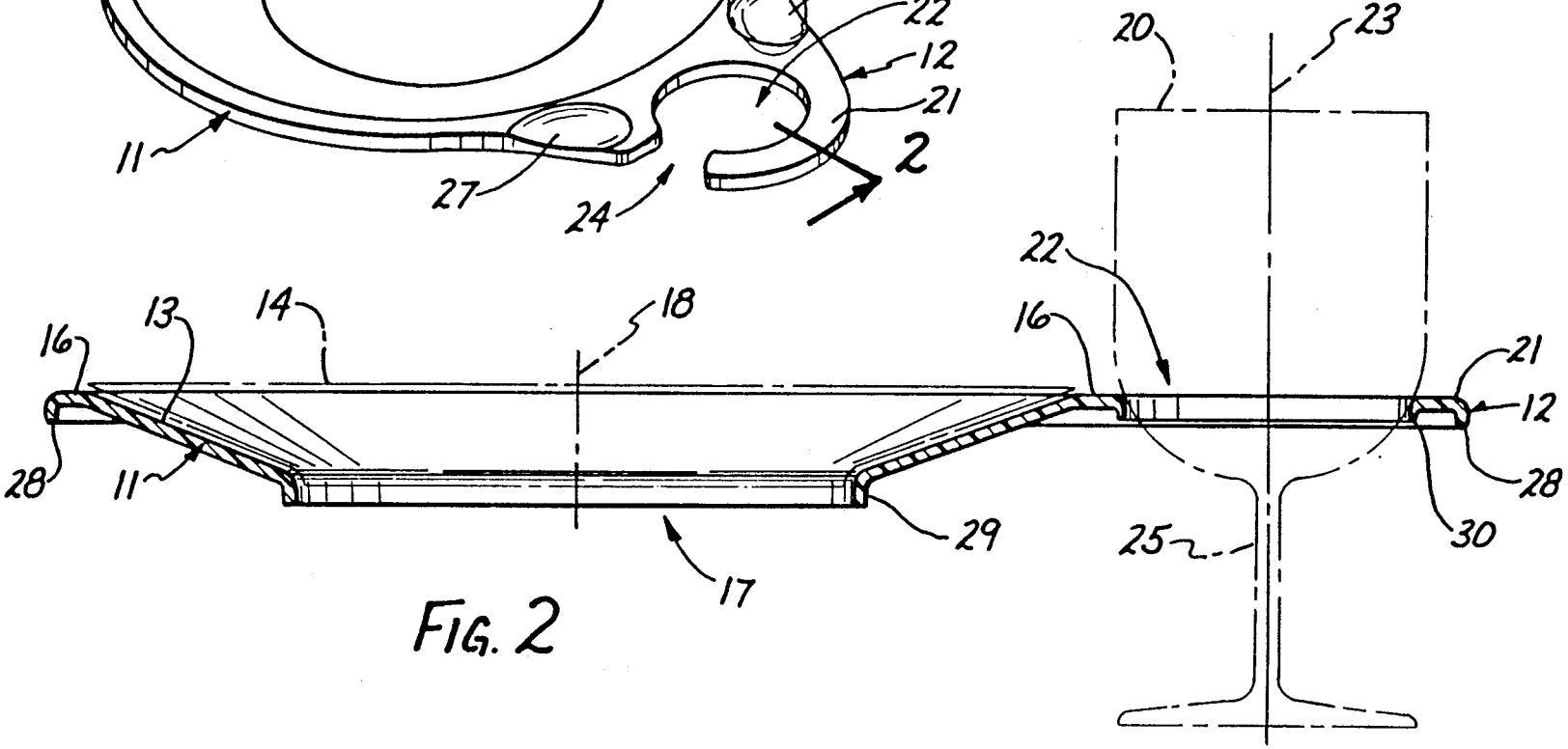
FIG. 2 is a cross sectional view taken on line 2—2 of FIG. 1.

FIGS. 1 and 2 illustrate a device 10 constructed according to the invention. Generally, the device 10 includes a body of material having a first portion 11 and a second portion 12. Preferably, the first and second portions 11 and 12 are connected in unitary one-piece construction, although they could be fabricated separately and attached together by suitable means, such as bonding, without departing from the broader inventive concepts disclosed. In addition, the device 10 is composed of a suitably rigid material for holding a plate and glass, such as a thermoplastic material, although any of various other known materials can be used, including wood or paper.

The first portion 11 of the body of material has an upper surface 13 (FIGS. 1 and 2) on which a user can place a plate 14 (shown in phantom lines in FIG. 2) in order to support the plate 14. The plate 14 represents a conventional five to eight inch plate, such as a party plate and the body of material is dimensioned and arranged to enable the user to hold the body of material in one hand (the hand 15 in FIG. 1) with the surface 13 in an upwardly facing position (i.e., one in which the surface 13 can support the plate 14 without the plate 14 sliding off the surface 13. For illustrative clarity, the plate 14 is shown in FIG. 2 slightly spaced apart from the surface 13. In actual use, however, the plate 14 rests directly on the surface 13 so that the plate 14 does not extend upwardly significantly beyond the upper peripheral surface 16 of the first portion 11 (preferably lying slightly below the surface 16). That is, the plate 14 is generally flush with the surface 16.

The first portion 11 of the body of material includes means for inhibiting lateral movement of the plate while the body of material is held by a user with the plate 14 on the surface 13. That is accomplished by having the first portion 11 dimensioned and arranged to cradle the plate 14. It cradles the plate 14 in the sense that the surface 13 generally conforms to the underside of the plate 14.

Stated another way, the first portion 11 of the body of material is in the form of what may be called a bottomless dish or plate that is dimensioned and arranged to receive and support the plate 14. That is, the first portion 11 defines a bottomless depression that extends from the surface 16 to an opening 17 extending through the first portion 11 that is centered on an axis 18 (FIG. 2), and the bottomless depression is dimensioned and arranged to receive the plate 14 with the first portion 11 of the body of material in a supporting relationship to the plate 14. The illustrated opening 17 is circularly shaped and the first portion 11 has an annular shape, although they may be otherwise shaped within the broader inventive concepts disclosed (depending on the shape of the plate to be held). A circularly shaped bottomless dish better matches the party plates in common use. In that regard, the term bottomless dish (or plate) denotes that the first portion 11 conforms somewhat to the underside of the plate 14 so that it is somewhat like a slightly enlarged version of the plate 14 with the bottom removed so that the plate 14 nestles securely in the bottomless depression.

Considering the second portion 12 in further detail, it serves as means for supporting a beverage container (such as a glass 20 shown in FIG. 2, which need not be a wine glass) next to the plate 14 (i.e., near to and preferably slightly spaced apart from the plate). For that purpose, the second portion 12 a ring in which to place a portion of the glass 20 with the second portion 12 in a supporting relationship to the glass 20. In other words, the glass 20 rests upon an upwardly and inwardly facing surface 21 of the second portion 12. In that regard, use of the word "glass" is intended to denote any of various known beverage containers regardless of composition, be it glass, plastic, paper, foam, or other material, and regardless of size and shape.

The illustrated second portion 12 defines a circularly shaped opening 22 that extends through the second portion 12 (i.e., it is bottomless), centered on an axis 23 that is generally parallel to the axis 18 and spaced apart from the axis 18 sufficiently so that the glass 20 and the plate 14 do not interfere with each other. The second portion 12 also defines an accessway or channel 24 (FIG. 1) that is dimensioned and arranged to enable passage of the stem of a conventional wine glass (such as the stem 25 of the glass 20) to a position within the ring. After passing the stem 25 through the channel 24 into the opening 22, the user lowers the glass 20 until it rests upon the surface 21. Then the user holds the device 10 in one hand as shown in FIG. 1, with the tip of the thumb of the hand 15 placed in the thumb depression 26. A second thumb depression 27 is provided for those who would hold the device 10 in their right hand. Another feature of the device 10 is that the user can set it down, on a table for example, with the glass 20 then resting directly on the table.

The device 10 also includes at least one bead that provides greater material thickness to increase device rigidity. For that purpose, the device 10 includes a first bead 28 disposed along the peripheral edge, a second bead 29 disposed along the periphery of the central opening 17 in the first portion 11, and a third bead 30 disposed along the periphery of the opening 22 in the second portion 12.

The illustrated device 10 is shaped and dimensioned for use in holding conventional five to eight inch plates. Enlarged or reduced models may be employed for different size plates within the inventive concepts disclosed. As an idea of size, the first portion of the illustrated device 10 has an eight-inch outside diameter and the opening 17 has a four and one-half inch diameter. The first and second axes 18 and 23 are spaced apart five and one-eight inches, the opening 22 in the second portion 12 has a two and one-fourth inch diameter, the surface 13 is inclined twenty-five degrees to the horizontal (sixty-five degrees to the axes 18), and the channel 24 is three-fourths inch wide. Of course, those dimensions may vary according to the precise application in order to receive a particular size plate and beverage container and enable a user to hold them both in one hand. Preferably, they are such as to make the device light and stackable in the sense that the shape of the downwardly facing underside of the device 10 closely conforms to the shape of the upwardly facing upper surface 13 so that two devices can nestle closely together when stacked one upon the other (i.e., they are easily stacked).

Thus, the invention provides a device for supporting a plate and beverage container with one hand that takes the form of a bottomless dish. The bottomless dish has a first portion that is dimensioned and arranged to receive and support the plate and a second portion that is dimensioned and arranged to support the beverage container. The bottomless dish cradles the plate to inhibit lateral movement while a user supports both the plate and the beverage container by holding the bottomless dish in one hand. The device is compatibly with existing party plates. It is relatively uncomplicated and inexpensive. It is less bulky. It can be configured to make it stackable. It avoids compartments prone to collect food residue, and it can be reused without cleaning after each use.

Although an exemplary embodiment of the invention has been shown and described, many changes, modifications, and substitutions may be made by one having ordinary skill in the art without necessarily departing from the spirit and scope of the invention.

What is claimed is:

1. A device for supporting a plate and a beverage container with just one hand, comprising:

a body of material having the form of a circularly shaped bottomless plate approximately the size of a conventional circularly shaped plate to be supported;

the body of material defining just one bottomless depression in which to support the plate and just one bottomless opening in which to support a beverage container next to the plate;

the body of material also defining an accessway to the bottomless opening, which accessway is dimensioned and arranged to enable passage of the stem of a conventional wine glass to a position such that the stem extends through the opening; and the bottomless depression being so configured that the body of material has an upper surface with a shape generally conforming to the underside of the plate in order to cradle the plate in a close supporting relationship such that a substantial majority of the body of material is disposed beneath the plate in a position generally out of the sight of an individual viewing the device from a position above the plate.

2. A device as recited in claim 1, wherein:

the bottomless depression includes a central opening extending through the body of material along a first axis;

the bottomless opening includes an opening extending through the body of material along a second axis that is generally parallel to the first axis; and the first and second axes are spaced apart a distance such that the plate does not overlap the opening when the plate is supported within the depression.

3. A device as recited in claim 1, wherein the body of material includes at least one bead to increase rigidity of the device.

4. A device as recited in claim 1, wherein at least a portion of the body of material is composed of a thermoplastic material.

5. A device as recited in claim 1, wherein the device is dimensioned and arranges so that it is stackable.

6. A device as recited in claim 1, wherein the device is of unitary, one-piece construction.

7. A device as recited in claim 1, wherein the body of material is just slightly larger than the plate.

8. A device as recited in claim 1, wherein the body of material is circularly shaped with a diameter larger than the diameter of a conventional party plate of predetermined size.

9. A device as recited in claim 1, wherein, the body of material defines at least one depression shaped and dimensioned to receive a portion of the thumb of the user when the device is held in the hand of the user in order to guide placement of the hand of the user on the device.

10. A device for supporting a plate and a beverage container with just one hand, comprising:

a body of material having the form of a circularly shaped bottomless plate approximately the size of a conventional circularly shaped plate to be supported;

the body of material defining just one bottomless depression in which to support the plate and just one bottomless opening in which to support a beverage container next to the plate;

the bottomless depression being so configured that the body of material has an upper surface with a shape generally conforming to the underside of the plate in order to cradle the plate in a close supporting relationship such that a substantial majority of the body of material is disposed beneath the plate in a position generally out of the sight of an individual viewing the device from a position above the plate.

* * * * *